US006248510B1

(12) United States Patent
Anderson et al.

(10) Patent No.: US 6,248,510 B1
(45) Date of Patent: Jun. 19, 2001

(54) MOTION PICTURE INTERMEDIATE FILM WITH PROCESS SURVIVING ANTISTATIC BACKING LAYER

(75) Inventors: Charles C. Anderson, Penfield; Eugene A. Armour, Rochester; Robert J. Wilson, Webster; Robert P. Bouvy, Rochester, all of NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 09/546,886

(22) Filed: Apr. 10, 2000

(51) Int. Cl.[7] ..... G03C 1/83; G03C 1/85; G03C 1/89; G03C 1/825; G03C 7/22

(52) U.S. Cl. ..... 430/396; 430/432; 430/510; 430/517; 430/522; 430/527; 430/507

(58) Field of Search ..... 430/510, 517, 430/522, 527, 296, 432, 507

(56) References Cited

U.S. PATENT DOCUMENTS

| | | | |
|---|---|---|---|
| 5,190,851 | 3/1993 | Chari et al. | 430/505 |
| 5,283,164 | 2/1994 | Fenton et al. | 430/506 |
| 5,399,468 | 3/1995 | Sawyer et al. | 430/505 |
| 5,679,505 | 10/1997 | Tingler et al. | 430/527 |
| 5,723,272 | 3/1998 | Barber et al. | 430/522 |
| 5,747,232 | 5/1998 | Anderson et al. | 430/527 |

FOREIGN PATENT DOCUMENTS 582 000 2/1994 (EP) .

*Primary Examiner*—Richard L. Schilling
(74) *Attorney, Agent, or Firm*—Andrew J. Anderson

(57) ABSTRACT

A motion picture intermediate film has on one side of a support material, in order, an antihalation undercoat and at least one silver halide emulsion layer; and on the opposite side of the support a transparent, process surviving antistatic backing layer. The transparent, antistatic backing layer retains its antistatic properties after photographic film processing so that the motion picture intermediate film is protected from the generation of static charge during high speed printing of, for example, motion picture print films. The antistatic backing layer of the invention has a resistivity of less than about $1\times10^{11}$ Ω/□ after film processing. In a most preferred embodiment, the motion picture intermediate film of the invention is used to print images onto a motion picture print film that has a transparent antistatic backing layer. In accordance with the invention, use of a motion picture intermediate film as described above in making multiple prints onto motion picture print film results in surprisingly decreased levels of dirt and other image defects in the projected motion picture print film images, especially where such intermediate film is used to print onto print films having a process surviving antistatic backing layer.

9 Claims, No Drawings

MOTION PICTURE INTERMEDIATE FILM WITH PROCESS SURVIVING ANTISTATIC BACKING LAYER

FIELD OF THE INVENTION

This invention relates to an improved motion picture intermediate film used in the production of motion picture print films. In particular, the invention relates to a motion picture intermediate film having on one side of a support material an antihalation undercoat layer and at least one silver halide emulsion layer, and on the opposite side, a transparent, process surviving antistatic backing layer. The motion picture intermediate films of the invention attract less dirt during the high speed printing of motion picture print films thereby allowing the production of cleaner print films for viewing in movie theaters.

BACKGROUND OF THE INVENTION

Motion picture photographic films used in producing a release print (the film projected in movie theaters) include camera origination film, intermediate film, and the release print film. Current practice for most color motion picture production involves the use of at least four photographic steps. The first step is the recording of the scene onto a camera negative photographic film. While the original negative (typically after editing) may be printed directly onto a negative working print film in a second step to produce a direct release print, most motion picture productions use an additional two intermediate steps. Typically, the original camera negative film is printed onto a negative working intermediate film, such as Eastman Color Intermediate Film, yielding a master positive. The master positive is subsequently printed again onto an intermediate film providing a duplicate negative. Finally, the duplicate negative is printed onto a print film forming the release print. In practice, several duplicate negative copies are produced from the master positive, and each of the duplicate negatives may then be used to make hundreds of print film copies. This multistep process helps save the integrity of the valuable original camera negative film in preparing multiple release prints. In certain situations, usually involving special effects, intermediate film may be used an additional two or more times in preparing the final duplicate negatives to be used in printing the release prints. In this case, the first duplicate negative is used to print onto intermediate film to produce a second master positive, which is in turn used to produce a second duplicate negative. The second duplicate negative may be then used for printing the release prints.

The photographic industry has long recognized the need to provide photographic elements with some form of antihalation protection. Halation has been a persistent problem with photographic films comprising one or more photosensitive silver halide emulsion layers coated on a transparent support. The emulsion layer diffusely transmits light, which then reflects back into the emulsion layer from the support surface. The silver halide emulsion is thereby reexposed at locations different from the original light path through the emulsion, resulting in "halos" on the film surrounding images of bright objects.

One method frequently employed for antihalation protection in photographic films comprises providing a dyed or pigmented layer behind a clear support as an antihalation backing layer, wherein the backing layer is designed to be removed during processing of the film. Typical examples of such antihalation backing layers comprise a light absorbing dye or pigment (such as carbon black) dispersed in an alkali-soluble polymeric binder (such as cellulose acetate hexahydrophthalate) that renders the layer removable by soaking in an alkaline photographic processing solution, scrubbing the backside layer, and rinsing with water. Such carbon containing "rem-jet" backing layers have been commonly used for antihalation protection in motion picture origination, intermediate, and print release films. The carbon particles additionally provide antistatic protection prior to being removed, helping to avoid fogging caused by sparks during film transport. Photographic films utilizing a carbon black-containing layer are described, e.g., in U.S. Pat. Nos. 2,271,234, 2,327,828, 2,976,168, 3,753,765, 3,881,932, 4,301,239, 4,914,011, and 4,990,434.

While such carbon black containing backing layers provide effective antihalation and antistatic protection for photographic films prior to processing, their use requires special additional processing steps for their subsequent removal, and incomplete removal of the carbon particles can cause image defects in the resulting print film. Additionally, it has been found to be desirable to provide "process surviving" antistatic protection for motion picture print films in order to prevent static build-up even after imagewise exposure and processing, as such print films are subject to rapid transport through projection apparatus where static charges can attract dust particles which may detrimentally impact a projected image. Accordingly, alternatives for carbon-containing, process-removable, antihalation/antistatic backing layers have been proposed for motion picture films. One such alternative is to use antihalation undercoat layers containing filter dyes coated between the support and the emulsion layers wherein the filter dyes are solubilized and removed and/or decolorized during processing of the film, and a separate process-surviving antistatic backing layer, such as described in U.S. Pat. Nos. 5,679,505 and 5,723,272. Dyes may be selected and used in combinations to provide antihalation protection throughout the visible spectrum. Process-surviving antistatic layers typically include, e.g., ionic polymers, electronic conducting non-ionic polymers, and metal halides or metal oxides in polymeric binders. Conductive fine particles of crystalline metal oxides dispersed with a polymeric binder have been found to be especially desirable for preparing optically transparent, humidity insensitive, antistatic layers for various imaging applications. The use of such antihalation undercoat and process-surviving antistatic protection layers in recent commercial motion picture print release films has resulted in improved (i.e., decreased) dirt levels observed upon projection of motion picture images.

A motion imaging film having on one side of a support material, in order, a process surviving, electrically conductive subbing layer, a photographic emulsion, and a protective overcoat; and on the opposite side a carbon black-containing backing layer, and optionally, a lubricant layer is described in U.S. Pat. No. 5,747,232. Although the '232 patent discloses the use of motion imaging films having a process surviving subbing conductive layer, the retained need for the use of carbon black-containing layers is undesirable from the standpoint of film cleanliness. In addition, after processing the lubricant that is normally applied over the carbon black-containing layer is also removed and, therefore, the processed film has a high coefficient of friction on the backside of the film which is undesirable for good transport and film durability during repeated cycles in a high speed printer.

The use of antihalation undercoat layers and interlayers in place of carbon-containing backing layers has also been suggested for camera origination and intermediate films, such as disclosed, e.g., in EP 0582 000. Such suggestions, however, have not included reference to the need for process-surviving antistatic protection for such films, as these films are typically not used in theaters for projection purposes. EP 0 582 000 itself specifically states use of an antistatic layer comprising polystyrene sulfonic acid sodium salt is preferred, which material would not provide substantially process-surviving antistatic protection, as without a protective topcoat the antistatic performance of these electroconductive polymers may be greatly diminished after processing.

While the use of antihalation undercoat layers and process-surviving antistatic backcoat layers in recent commercial motion picture print release films has resulted in improved (i.e., decreased) dirt levels observed upon projection of motion picture images, it would be desirable to further decrease dirt and other image defect levels observed during projection of motion picture films.

SUMMARY OF THE INVENTION

In accordance with this invention, a motion picture intermediate film has on one side of a support material, in order, an antihalation undercoat and at least one silver halide emulsion layer; and on the opposite side of the support a transparent, process surviving antistatic backing layer. The transparent, antistatic backing layer retains its antistatic properties after photographic film processing so that the motion picture intermediate film is protected from the generation of static charge during high speed printing of, for example, motion picture print films. The antistatic backing layer of the invention has a resistivity of less than about $1\times10^{11}$ Ω/□ after film processing.

In a preferred embodiment, the backside of the intermediate film of the invention also has a lubricant-containing layer that survives film processing in order to improve transport and wear properties after processing.

In a most preferred embodiment, the motion picture intermediate film of the invention is used to print images onto a motion picture print film that has a transparent antistatic backing layer.

In accordance with the invention, use of a motion picture intermediate film as described above in making multiple prints onto motion picture print film results in surprisingly decreased levels of dirt and other image defects in the projected motion picture print film images, especially where such intermediate film is used to print onto print films having a process surviving antistatic backing layer.

DETAILED DESCRIPTION OF THE INVENTION

This invention relates to a photographic motion picture intermediate film. The motion picture intermediate film has on one side of a support material, in order, an antihalation undercoat and at least one silver halide emulsion layer; and on the opposite side a transparent, process surviving antistatic backing layer.

The use of a process surviving antistatic layer in accordance with the invention results in a decrease in static charge generation which may occur on processed motion picture intermediate films when transported through exposure equipment during the print film printing operation. During a typical printing operation in accordance with the prior art, a processed intermediate film that does not have antistatic protection is used as the master to duplicate an image onto a raw print film that has antistatic protection. Static charge buildup may occur on the intermediate film which may cause any particles on the print film (for example film debris generated during the finishing (slitting and perforating) of the print film) to be attracted from the antistat-protected unprocessed print film to the unprotected and statically charged processed intermediate film. Once on the film surface, these dirt particles can create abrasions and scratches. Intermediate films that contain such abrasions and scratches or, if sufficiently large, the dirt particles themselves, may transfer the image of these defects onto the print film during subsequent printing operations. Since a single copy of an intermediate film may be used to make many hundreds of print film copies, the printing operation may cause a very significant buildup of particles on the charged intermediate film, which can lead to the subsequent production of "dirty" prints. Therefore, controlling static charge buildup and reducing dirt attraction has been found to be especially critical for processed intermediate films, especially when one considers that the above described printing operation normally involves speeds in excess of 650 m/min (2000 ft/min). Additionally, reduced static charging generated on an intermediate film during the exposure of the print film in a high speed printer in turn results in reduced levels of static discharges which may cause static marks in the unprocessed print film. Thus, while the intermediate film itself is not projected for viewing in motion picture theaters, it has been found that improved quality of the projected images of a motion picture print film can be obtained through use of an intermediate film having a process surviving antistatic backcoat layer in the motion picture film production process.

The photographic film supports materials used in the motion picture intermediate film elements of this invention typically are synthetic high molecular weight polymeric materials. These support materials may be comprised of various polymeric films, synthetic paper and the like, but polyester and triacetate film supports, which are well known in the art, are preferred. The thickness of the support is not critical. Conventional support member thicknesses of from about 50 to 250 micrometers (2 to 10 mils, or 0.002 to 0.010 inches) can be employed, for example, with very satisfactory results. Polyester support members typically employ a primer layer between the functional layers and the polyester support. Such primer layers are well known in the art and comprise, for example, a vinylidene chloride/methyl acrylate/itaconic acid terpolymer or vinylidene chloride/acrylonitrile/acrylic acid terpolymer as described in U.S. Pat. Nos. 2,627,088; 2,698,235; 2,698,240; 2,943,937; 3,143,421; 3,201,249; 3,271,178 and 3,501,301.

The antihalation undercoat functions to prevent light from being reflected into the silver halide emulsion layer(s) and thereby causing an undesired spreading of the image which is known as halation. Any of the filter dyes known to the photographic art can be used in the present invention as a means of reducing halation. Thus, for example, water-soluble dyes can be used for this purpose. Such dyes should be incorporated in the antihalation undercoat with a mordant to prevent dye diffusion. Alternatively, and preferably, a solid particle filter dye is incorporated in the antihalation undercoat.

Useful water-soluble filter dyes for the purpose of this invention include the pyrazolone oxonol dyes of U.S. Pat. No. 2,274,782, the solubilized diaryl azo dyes of U.S. Pat. No. 2,956,879, the solubilized styryl and butadienyl dyes of U.S. Pat. Nos. 3,423,207 and 3,384,487, the merocyanine dyes of U.S. Pat. No. 2,527,583, the merocyanine and oxonol dyes of U.S. Pat. Nos. 3,486,897; 3,652,284 and 3,718,472, the enamino hemioxonol dyes of U.S. Pat. No. 3,976,661, the cyanomethyl sulfone-derived merocyanines of U.S. Pat. No. 3,723,154, the thiazolidones, benzotriazoles, and thiazolothiazoles of U.S. Pat. Nos. 2,739,888; 3,253,921; 3,250,617 and 2,739,971, the triazoles of U.S. Pat. No. 3,004,896, and the hemioxonols of U.S. Pat. Nos. 3,125,597 and 4,045, 229. Useful mordants are described, for example, in U.S. Pat. Nos. 3,282,699; 3,455, 693; 3,438,779 and 3,795,519.

Preferred examples of solid particle filter dyes for use in antihalation undercoat layers include those which are substantially insoluble at aqueous coating pH's of less than 7, and readily soluble or decolorizable in aqueous photographic processing solutions at pH of 8 or above, so as to be removed from or decolorized in a photographic element upon photographic processing. By substantially insoluble is meant dyes having a solubility of less than 1% by weight, preferably less than 0.1% by weight. Such dyes are generally of the formula:

$$D—(X)_n$$

where D represents a residue of a substantially insoluble compound having a chromophoric group, X represents a group having an ionizable proton bonded to D either directly or through a bivalent bonding group, and n is 1–7. The residue of a compound having a chromophoric group may be selected from conventional dye classes, including, e.g., oxonol dyes, merocyanine dyes, cyanine dyes, arylidene dyes, azomethine dyes, triphenylmethane dyes, azo dyes, and anthraquinone dyes. The group having an ionizable proton preferably has a pKa (acid dissociation constant) value measured in a mixed solvent of water and ethanol at 1:1 volume ratio within the range of 4 to 11, and may be, e.g., a carboxyl group, a sulfonamido group, a sulfamoyl group, a sulfonylcarbamoyl group, a carbonylsulfamoyl group, a hydroxy group, and the enol group of a oxonol dye or ammonium salts thereof. The filter dye should have a log P hydrophobicity parameter of from 0–6 in its non-ionized state. Such general class of ionizable filter dyes is well known in the photographic art, and includes, e.g., dyes disclosed for use in the form of aqueous solid particle dye dispersions as described in International Patent Publication WO 88/04794, European patent applications EP 594 973; EP 549 089; EP 546 163 and EP 430 180; U.S. Pat. Nos. 4,803,150; 4,855,221; 4,857,446; 4,900,652; 4,900,653; 4,940,654; 4,948,717; 4,948,718; 4,950,586; 4,988,611; 4,994,356; 5,098,820; 5,213,956; 5,260,179 and 5,266,454; the disclosures of each of which are herein incorporated by reference. Such dyes are generally described as being insoluble in aqueous solutions at pH below 7, and readily soluble or decolorizable in aqueous photographic processing solutions at pH 8 or above.

Preferred dyes of the above formula include those of formula:

$$[D—(A)_y]—X_n$$

where D, X and n are as defined above, and A is an aromatic ring bonded directly or indirectly to D, y is 0 to 4, and X is bonded either on A or an aromatic ring portion of D.

Exemplary dyes of the above formulas include those in Tables I to X of WO 88/04794, formulas (I) to (VII) of EP 0 456 163 A2, formula (II) of EP 0 594 973, and Tables I to XVI of U.S. Pat. No. 4,940,654 incorporated by reference above. Preferred examples of solid particle filter dyes include the following:

D-1

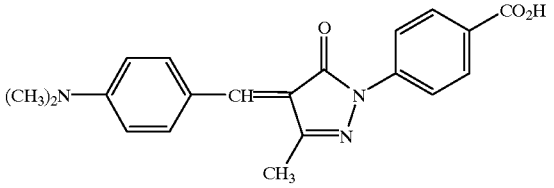

D-2

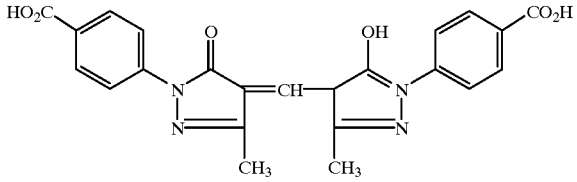

D-3

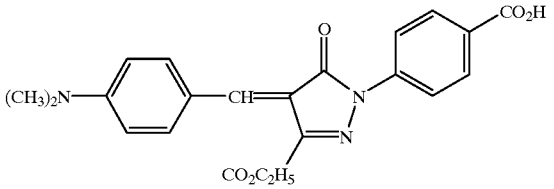

D-4

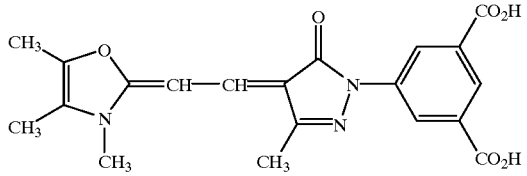

D-5

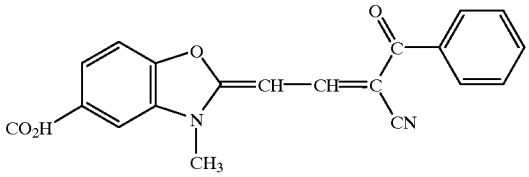

D-6

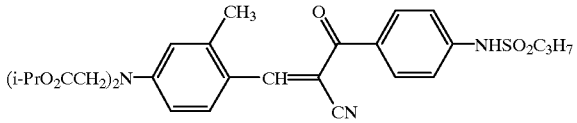

D-7

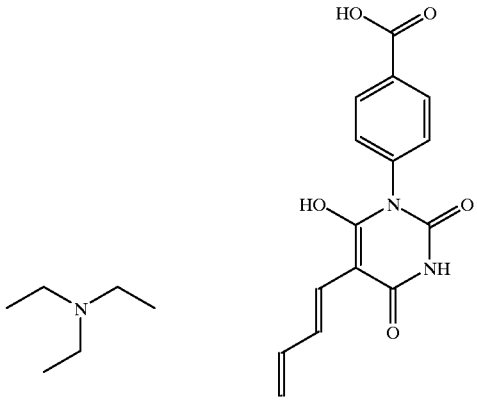

-continued

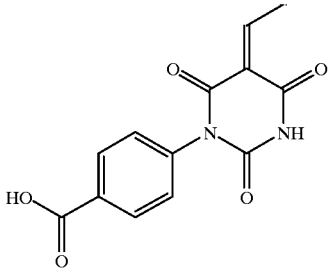

In preferred embodiments of the invention, the antihalation layer is a hydrophilic colloid layer, the hydrophilic colloid preferably being gelatin. This may be any gelatin or modified gelatin, or another water-soluble polymer or copolymer or mixtures thereof with gelatin. The antihalation layer is preferably present between the support an all silver halide emulsion layers.

To promote adhesion of the antihalation undercoat to the support, primer layers as hereinabove described are advantageously employed, especially when the support is a polyester support.

The photographic elements of the present invention are preferably multilayer and/or multicolor elements. The color intermediate films of preferred embodiment of the invention are designed for duplication of a color motion picture film, and for this purpose contains photographic silver halide emulsions that are preferably very fine grain photographic silver halide emulsions containing an average grain size of less than 0.30 micrometer, especially a grain size within the range of 0.04 to 0.25 micrometer. A preferred range for cubic silver halide emulsions is 0.04 to 0.20 micrometer.

The layer order of the duplicating element as described can be any order that enables the duplication to provide a duplicate image that enables formation of a print image that is visually indistinguishable from the original image. Color photographic elements in accordance with preferred embodiments of this invention typically will contain dye image-forming units sensitive to each of the three primary regions of the spectrum. Each unit can be comprised of a single silver halide emulsion layer or of multiple emulsion layers sensitive to a given region of the spectrum. The layers of the element, including the layers of the image-forming units, can be arranged in various orders as is well known in the art. The usual construction of a motion picture color intermediate film is to have three records, each record having one or more layers containing emulsions sensitive to different regions of the spectrum, namely the red, green and blue light sensitive layers. Those layers contain color forming compounds which produce cyan, magenta and yellow dyes, respectively, in accordance with the amount of light of red, green and blue colors to which the film is exposed. The records are typically arranged with the red record lowest (that is, furthest from the light source when the film is exposed in a normal manner), followed by the green record above the red record and the blue record above the green record. Preferably each of the color records comprises a unit of layers preferably comprising one, two or three layers that have different photosensitivity and form the same or essentially the same image dye hue.

The photographic silver halide emulsions in each of the layers are comprised of very fine grain photographic silver halides. To provide sufficient photographic speed in a very fine grain emulsion, intermediate films typically use high bromide (i.e., greater than 50 mole percent bromide, based on silver) silver halide emulsions, preferably silver bromoiodide emulsions. The emulsions can include silver halide grains of any conventional shape or size provided that the shape and size selected enable the duplication results as described. The emulsions preferably comprise silver bromoiodide grains that are cubic grains and/or T-grains. The T-grain photographic silver halide emulsions can be prepared by any procedure known in the photographic art for preparation of such grains. The T-grain photographic silver halide can be any of the T-grain photographic silver halides described in, for example, U.S. Pat. Nos. 4,434,226; 4,414,310; 4,399,215; 4,433,048; 4,386,156; 4,504,570; 4,400,463; 4,414,306; 4,435,501; 4,643,966; 4,672,027 and 4,693,964. The silver halide grains can be either monodisperse or polydisperse as precipitated. The grain size distribution of the emulsions can be controlled using techniques known in the photographic art.

A preferred intermediate element as described comprises a support, preferably a film support, bearing on one side thereof, in sequence: (a) an antihalation undercoat; (b) at least one red-sensitive photographic silver bromoiodide emulsion layer comprising a cyan image-dye forming coupler; (c) at least one green-sensitive photographic silver bromoiodide emulsion layer comprising a magenta image-dye forming coupler and (d) at least one blue-sensitive photographic silver bromoiodide emulsion layer comprising a yellow image-dye forming coupler; and wherein the photographic silver bromoiodide in each of the emulsion layers has an average grain size of less than 0.30 micrometers, more preferably within the range of 0.04 to 0.25 micrometers.

The photographic silver halide emulsions utilized in this invention can contain other addenda conventional in the photographic art. Useful addenda are described, for example, in *Research Disclosure*, Item 36544, September, 1994. Useful addenda include spectral sensitizing dyes, desensitizers, antifoggants, masking couplers, DIR couplers, DIR compounds, antistain agents, image dye stabilizers, absorbing materials such as filter dyes and UV absorbers, light-scattering materials, coating aids, plasticizers and lubricants, and the like.

The couplers and other components of the described duplicating element can be prepared by methods known in the organic synthesis art and the photographic art. The duplicating element as described can be exposed as described in Research Disclosure paragraph XVIII.

Depending upon the dye-image-providing material employed in the photographic element, it can be incorporated in the silver halide emulsion layer or in a separate layer associated with the emulsion layer. The dye-image-providing material can be any of a number known in the art, such as dye-forming couplers, bleachable dyes, dye developers and redox dye-releasers, and the particular one employed will depend on the nature of the element, and the type of image desired.

Dye-image-providing materials employed with conventional color materials designed for processing with separate solutions are preferably dye-forming couplers; i.e., compounds which couple with oxidized developing agent to form a dye. Preferred couplers which form cyan dye images are phenols and naphthols. Preferred couplers which form magenta dye images are pyrazolones and pyrazolotriazoles. Preferred couplers which form yellow dye images are benzoylacetanilides and pivalylacetanilides.

Further details with respect to possible photographic emulsions and related photographic element component features for use in motion picture intermediate films, and combination of such component features, may be found in U.S. Pat. Nos. 5,190,851, 5,283,164, and 5,399,468, the disclosures of which are incorporated by reference herein.

The process surviving antistatic backing layer of the invention may be a single layer containing a conductive agent that is inherently stable toward photographic processing solutions or the antistatic backing layer may be an antistatic layer containing a conductive agent that is overcoated with a protective topcoat to protect the antistatic layer from scratch and abrasion and attack by film processing solutions. The antistatic backing layer has a resistivity of less than about $1\times10^{11}$ Ω/□ after film processing.

Conductive agents which may be used in the antistatic layer of the invention include, for example:

(1) electrically conductive metal-containing particles including donor-doped metal oxides, metal oxides containing oxygen deficiencies, and conductive nitrides, carbides, and borides. Specific examples of particularly useful particles include conductive $TiO_2$, $SnO_2$, $V_2O_5$, $Al_2O_3$, $ZrO_2$, $In_2O_3$, ZnO, $ZnSb_2O_6$, $InSbO_4$, $TiB_2$, $ZrB_2$, $NbB_2$, $TaB_2$, CrB, MoB, WB, $LaB_6$, ZrN, TiN, WC, HfC, HfN, and ZrC. Examples of the patents describing these electrically conductive particles include; U.S. Pat. Nos. 4,275,103, 4,394,441, 4,416,963, 4,418,141, 4,431,764, 4,495,276, 4,571,361, 4,999,276, 5,122,445 and 5,368,995.

(2) fibrous conductive powders comprising, for example, antimony-doped tin oxide coated onto non-conductive potassium titanate whiskers as described in U.S. Pat. Nos. 4,845,369 and 5,116,666 and antimony-doped tin oxide fibers or "whiskers" as described in U.S. Pat. No. 5,719,016 and 5,073,119.

(3) the electronically-conductive polyanilines, polyacetylenes, polythiophenes, and polypyrroles of U.S. Pat. Nos. 4,237,194; 4,987,042; 5,035,926; 5,354,613; 5,370,981; 5,372,924; 5,543,944 and 5,766,515, and Japanese Patent Applications 2282245 and 2282248, and the cross-linked vinylbenzyl quaternary ammonium polymers of U.S. Pat. No. 4,070,189.

The above mentioned conductive agents are preferably applied with a polymeric binder. Various polymer binders may be used to form the layer such as gelatin, cellulose derivatives, polyurethanes, polyesters, interpolymers of ethylenically unsaturated monomers such as (meth)acrylic acid and its esters, styrene and its derivatives, vinyl chloride, vinylidene chloride, butadiene, and others.

The above mentioned conductive agents may be used in a single-layer antistatic backing or may be employed in an antistatic layer that is overcoated with a protective topcoat.

Conductive agents that are soluble in or otherwise affected by film processing solutions may also be effectively employed in the present invention when an impermeable protective topcoat is applied over the antistatic layer containing such conductive agents. Examples of these conductive agents include the ionically-conductive cross-linked vinylbenzyl quaternary ammonium polymers of U.S. Pat. No. 4,070,189 or the electronically-conductive colloidal gel of vanadium pentoxide or silver-doped vanadium pentoxide as described in U.S. Pat. Nos. 4,203,769, 5,006,451, 5,221,598, 5,284,714 and 5,368,995. These conductive agents are applied with a polymeric binder to form the antistatic layer. Various polymer binders may be used to form this layer such as gelatin, cellulose derivatives, polyurethanes, polyesters, interpolymers of ethylenically unsaturated monomers such as (meth)acrylic acid and its esters, styrene and its derivatives, vinyl chloride, vinylidene chloride, butadiene, and others. Use of a polymer binder, such as a vinylidene chloride-containing terpolymer latex or a polyesterionomer dispersion, is preferably employed to improve the integrity of the antistatic layer and to improve adhesion to the underlying support material. Antistatic layers containing vanadium pentoxide provide excellent protection against static charge and have the advantage of excellent transparency and their performance is not significantly dependent on ambient humidity. The excellent performance of these antistatic layers results from the particular morphology of this material. The colloidal vanadium pentoxide gel consists of entangled, high aspect ratio, flat ribbons about 50–100 angstroms wide, about 10 angstroms thick and about 1000–10,000 angstroms long. Low surface resistivities can be obtained with very low vanadium pentoxide coverage as a result of this high aspect ratio morphology.

To provide protection of the antistatic layer from interacting with components of the processing solutions, a protective overcoat or barrier layer may be applied to the antistatic layer. Protective topcoats that may be applied over the antistatic layer can include essentially any known polymeric binder. Useful hydrophobic polymers that may be effectively employed in the protective topcoat include polyurethanes, polyesters, polyamides, polycarbonates, cellulose esters, acrylic polymers, styrenic polymers, and the like. Particularly preferred polymeric binders for use in the topcoat include aliphatic polyurethanes such as those described in U.S. Pat. No. 5,679,505 which is incorporated herein by reference. Hydrophilic colloids such as gelatin, for example, alkali-treated gelatin (cattle bone or hide gelatin), acid-treated gelatin (pigskin gelatin) and gelatin derivatives such as acetylated gelatin, phthalated gelatin and the like may also be used in topcoats. Other hydrophilic colloids that can be utilized alone or in combination with gelatin include dextran, gum arabic, zein, casein, pectin, collagen derivatives, collodion, agar-agar, arrowroot, albumin, and the like. Still other useful hydrophilic colloids are water-soluble polyvinyl compounds such as polyvinyl alcohol, polyacrylamide, poly(vinylpyrrolidone), and the like.

Typically, the antistatic layer is coated at a dry coverage of from 1 to 1000 mg/m$^2$ based on total dry weight. The electrical resistivity of the antistatic layer is less than about 11 log Ω/□, preferably less than about 10 log Ω/□, more preferably less than about 9 log Ω/□. In addition to the process surviving antistatic layer present on the backside of the intermediate film element, a further antistatic protection layer may be present on the front (photographic emulsion layer) side of the support material.

In addition to the conductive agent and polymer binder, the antistatic layer and protective topcoat, if present, may optionally include coating aids, dispersants, hardeners and crosslinking agents, surface active agents, charge control agents, thickeners, matting agents, ultraviolet light absorbers, process removable dyes, high boiling point solvents, colloidal inorganic particles, magnetic recording particles, and lubricants.

Useful lubricants which may be included in the antistatic layer or the protective topcoat include silicones, natural and synthetic waxes, stearates, amides, and perfluourinated polymer particles. The lubricants should be included to give the backside of the film a coefficient of friction that ensures good transport characteristics and resistance to scratch and abrasion during manufacturing and customer use. For satisfactory transport characteristics the backside of the film should have a friction coefficient of from 0.1 to 0.4. However, the most preferred range is from 0.15 to 0.3. If the backside of the film has a coefficient of friction below 0.15, there is a significant danger that long, slit rolls of the photographic film will become unstable in storage or shipping and become telescoped or dished, a condition common to unstable film rolls. If the coefficient of friction is above 0.30 at manufacture or becomes greater than 0.30 after photographic film processing, a common condition of non-process surviving protective overcoat lubricants, the photographic film transport characteristics become poorer, particularly in some types of photographic film printers.

In addition to an antihalation undercoat, one or more emulsion layers and antistatic backcoat, the motion picture intermediate films of the present invention can contain auxiliary layers conventional in photographic elements, such as primer layers, subbing layers, spacer layers, filter layers, interlayers, pH lowering layers (sometimes referred to as acid layers and neutralizing layers), timing layers, barrier layers, protective overcoat and magnetic recording layers.

In accordance with preferred embodiments of the invention, for color intermediate films containing red, green and blue records in the order described above (that is, red record lowest), acutance of the red layer can be markedly increased to a level closer to that of the green record acutance with each layer still having high acutance and without excessive speed loss, by controlling three variables within certain parameters as described in U.S. Pat. No. 5,283,164, the disclosure of which is incorporated by reference herein. These variables are the silver halide particle size of the fastest blue sensitive layer (normally having the largest silver halide particles of all the layers), the silver laydown (sometimes referred to as silver "level") of the fastest blue-sensitive layer, and the levels of green and red absorbers present (note that a green or red absorbing dye would be colored magenta and cyan, respectively). Preferably, the red record acutance is closely matched to that of the green record. In particular, a closer matching of acutance is obtained in a such a film, preferably a color negative duplicating film, when all of the following conditions are satisfied:

1) the silver halide particles in the fastest blue sensitive layer have an average equivalent spherical diameter no greater than 0.3 micrometers, while in the remainder of the layers the silver halide particles have an average equivalent spherical diameter of no greater than 0.23 micrometers;
2) the silver level in the fastest blue sensitive layer is no greater than 300 $mg/m^2$; and
3) a sufficient level of red absorber is present so that the red record MTF(12) is at least 95% of the green record MTF(12) and the red record F50 is no more than 6 cycles/mm less than the green record F50. The percentage figures used in comparing MTF(12) values of the red and green absorbers are relative values, thus when it is stated that the red record MTF(12) is at least 95% of the green record MTF(12), this means that the red MTF(12) has a value which is 95% of the value of the green record MTF(12). Likewise, when the red record MTF(12) is stated to be within 5% of the green record MTF(12), this means within the red record MTF(12) has a value within 5% of the green record MTF(12). In addition, it is preferred that the red record have an MTF(12) of at least 90% (and more preferably at least 93%) and an F50 of at least 45 cycles/mm (and preferably at least 50 cycles/mm).

In accordance with the process of the invention, a motion picture film image is printed onto an intermediate film in accordance with the invention, the intermediate film is processed to form a developed image, and the developed image is then printed onto a motion picture print film to form multiple copies of the final print image. As described above, in motion picture color printing, there are usually three records to record simultaneously in the image area frame region of a print film, i.e., red, green and blue. The original image record to be reproduced is preferably an image composed of sub-records having radiation patterns in different regions of the spectrum. Typically it will be a multicolor record composed of sub-records formed from cyan, magenta and yellow dyes. The principle by which such materials form a color image are described in James, The Theory of the Photographic Process, Chapter 12, Principles and Chemistry of Color Photography, pp 335–372, 1977, Macmillan Publishing Co. New York, and suitable materials useful to form original records are described in Research Disclosure referenced above. Materials in which such images are formed can be exposed to an original scene in a camera, or can be duplicates formed from such camera origination materials, such as records formed in color negative intermediate films.

In current commercial practice, the spectral sensitivities of the intermediate film are selected to be similar to the print film. And, the combination of image dyes, also described herein as the dye set, of the intermediate film is selected to be similar to the camera negative film. This enables the intermediate film used to make a master positive to respond like a print film when printed from the camera negative film, but still produce a negative-like dye set. The intermediate film used to make a duplicate negative responds like a print to the master positive's negative-like dye, and also produces a negative-like dye set. Finally, the negative-like dye set of the duplicate negative prints properly onto print film.

The color correction of the intermediate film is selected to provide the best possible match in color reproduction between the direct print and the release print. Color correction is accomplished by means of interlayer interimage effects, masking couplers and color contamination. In current practice, it is desirable in an intermediate film to have a low level of interlayer interimage effects in order to limit color correction variations that might result as a function of exposure level. While some color contamination has been used, color correction has been accomplished mostly by use of masking couplers. One of the most important features of a duplicating element is the enablement of accurate color reproduction upon exposure and processing. In accordance with preferred embodiments of the invention, the duplicating element may use masking couplers and color contamination color correction features as described in U.S. Pat. No. 5,399,468, the disclosure of which is incorporated by reference herein, to enable formation of a duplicate image that enables formation of a print image with colors that are visually indistinguishable from the colors of the original image. Also, improved granularity for intermediate films in accordance with the invention may be achieved in accordance with the features described in U.S. Pat. No. 5,190,851, the disclosure of which is incorporated by reference herein.

The intermediate element can be processed by compositions and processes known in the photographic art for processing duplicating elements, especially processes and compositions known for preparation of duplicates of motion picture films. A typical example of a useful process is the ECN-2 process of Eastman Kodak Company, U.S.A. and the compositions used in such a process. Such as process and compositions for such a process are described in, for example, "Manual for Processing Eastman Color Films-H-24" available from Eastman Kodak Co. Processing to form a visible dye image includes the step of contacting the exposed element with a color developing agent to reduce developable silver halide and oxidize color developing agent. Oxidized developing agent in turn reacts with the couplers to yield dye. Any color developing agent is useful for processing the described duplicating element. Particularly useful color developing agents are described in, for example, U.S. Pat. No. 4,892,805 in column 17, the disclosure of which is incorporated herein by reference. In accordance with the invention, the intermediate film's antistatic backcoat layer survives such processing to provide a resistivity of less than about $1\times10^{11}$ Ω/□ after film processing.

After exposure and development of the intermediate film of the invention, the developed image is printed onto another intermediate film or a motion picture print film. Motion picture color print films typically comprise a support bearing, in order, light sensitive yellow, cyan, and magenta dye forming layers sensitized respectively to the blue (approx. 380–500 nm), red (approx. 600–760 nm), and green (approx. 500–600 nm) regions of the electromagnetic spectrum. Such materials are described in the Research Disclosure publications cited above. Such light sensitive materials may also be sensitive to one or more regions of the electromagnetic spectrum outside the visible, such as the infra red region of the spectrum. In accordance with preferred embodiments of the invention, the intermediate films having process surviving antistatic backcoat layers are used to print images onto motion picture print films also comprising process surviving antistatic backcoats. Such motion picture print films also preferably comprise antihalation undercoats in combination with the antistatic backing as described, e.g., in U.S. Pat. Nos. 5,679,505 and 5,723,272, the disclosures of which are incorporated by reference herein. The use of an intermediate film having process surviving antistatic protection is particularly desirable when printing multiple print copies from the intermediate film, as lower levels of dirt accumulate on the intermediate film resulting in cleaner printed copies. Use of the intermediate film in accordance with the invention in combination with a print film having process surviving antistatic protection results in the best overall position for the multiple print copies with respect to dirt and other projected image defects.

The following examples are intended to illustrate the present invention more practically but not to limit it in scope in any way.

EXAMPLES

A subbed polyester support was prepared by first applying a subbing layer comprising a vinylidene chloride copolymer to both sides of the support before drafting and tentering so that the final dried coating weight of the subbing layer was about 90 mg/m$^2$.

An antistatic coating was applied onto one side of the support having the following composition:

| | |
|---|---|
| Acrylonitrile/vinylidene chloride/acrylic acid copolymer binder | 2.6 mg/m$^2$ |
| Electrically-conductive silver-doped vanadium pentoxide fibers | 3.3 mg/m$^2$ |
| Coating surfactant | 3.7 mg/m$^2$ |

The antistatic layer had a resistivity of $3\times10^8$ Ω/□. A protective topcoat having the following composition was applied onto the antistatic layer:

| | |
|---|---|
| Sancure 898 polyurethane binder (B.F. Goodrich Corp.) | 900 mg/m$^2$ |
| CX100 polyfunctional aziridine crosslinker (Zeneca Resins) | 56 mg/m$^2$ |

-continued

| | |
|---|---|
| Coating Surfactant | 24 mg/m$^2$ |
| Michemlube 124 microcrystalline wax (Michelman, Inc.) | 1.2 mg/m$^2$ |
| NaCl | 2.2 mg/m$^2$ |
| Matting agent (polymethylmethacrylate beads, avg. size = 1.5 μm) | 2.5 mg/m$^2$ |

A conventional gelatin subbing layer was applied onto the vinylidene chloride copolymer subbing layer on the side of the support opposite to the antistatic layer and topcoat. Then, an antihalation undercoat having the following composition was applied onto the gelatin subbing layer:

| | |
|---|---|
| Gelatin | 1420 mg/m$^2$ |
| Solid particle dye D-7 | 80 mg/m$^2$ |
| Coating surfactant | 30 mg/m$^2$ |
| Sulfuric acid | 3.2 mg/m$^2$ |
| Poly(acrylamide-co-2-acrylamido-2-methylpropane sodium sulfonate) | 19 mg/m$^2$ |

Dye D-7 was incorporated in the form of a solid particle dispersion obtained by milling the dye in a manner similar to that described in Example 1 of U.S. Pat. No. 5,723,272.

The antihalation undercoat was then overcoated with fine silver bromoiodide emulsion layers (average grain sizes less than 0.30 micrometers) suitable for color motion picture intermediate film and a gelatin-containing protective overcoat was applied over the emulsion layer. This film sample of the invention was designated Example 1.

A conventional color motion picture intermediate film (Eastman Kodak ECI 2244) that has a carbon black-containing backing layer that is removed during film processing was used as a comparative example (designated Sample A).

The films were processed in a conventional motion picture film ECN-2 processor and the internal resistivity of the films (internal resistivity measured according to: R. A. Elder, Proc. EOS/ESD Sympos., EOS-12, pgs 251–4, September 1990) was determined after processing. Example 1 had a resistivity after film processing equal to $4\times10^8$ Ω/□ indicating that this film has process surviving antistatic properties. Comparative Sample A had a resistivity after film processing that was greater than $1\times10^{13}$ Ω/□ indicating that this film does not have antistatic properties after film processing.

To demonstrate the utility of the intermediate film of the invention, the following experiments were conducted using a testing station designed to simulate a high speed printing operation employed at a commercial motion picture film lab. An approximately 8 m (25 foot) length of processed intermediate film (i.e., either Example 1 or Sample A) was spliced into a closed loop and run continuously via sprocket drive and edge contact rollers through the testing station. An approximately 40 m (125 foot) length of raw motion picture print film was spliced into a closed loop and this was also run continuously through the testing station so that the intermediate film and print film came into direct contact at a sprocketed print head. The intermediate film and print film were transported through the testing station at approximately 850 m/min (2600 ft/min). The test was conducted so that the intermediate film was transported through the testing station a total of 1500 to 2500 times.

After the prescribed number of cycles through the testing station, the electric field (kV/cm$^2$) on the intermediate film was measured in-line at a distance of 1 cm from the moving film surface using a Monroe (4 channel) Static Monitor, Model 177, equipped with Model 1036 Sensors. Off-line measurement of debris on the films was completed using tacky-tape analysis. After completing the prescribed number of cycles through the testing station the debris present on the total film lengths was transferred onto an adhesive tape and mounted on a plastic slide for digital image analysis. The image analysis technique measured the number of particles collected from the films.

Two types of motion picture print film were used in the tests, Eastman Kodak ECP 2386 print film that has a carbon black-containing backing layer and Eastman Kodak ECP 2383 that has a transparent (non-carbon black-containing) antistatic backing layer similar to that of the Example 1 intermediate film.

The results obtained for the sample films are given in Table 1.

TABLE 1

| # Cycles | Intermediate film | Print Film | Electric Field on Intermediate Film, kV/cm$^2$ | Total Debris, Number of particles |
|---|---|---|---|---|
| 1500 | Sample A | ECP 2386 | 2 | 10900 |
| 1500 | Example 1 | ECP 2386 | 0.2 | 4500 |
| 2500 | Sample A | ECP 2383 | 9 | 5400 |
| 2500 | Example 1 | ECP 2383 | 0.5 | 3800 |

The results shown in Table 1 indicate that a motion picture intermediate film of the invention develops significantly lower electric fields that may otherwise attract dirt and debris during high speed printing compared with conventional intermediate films that do not have a process surviving antistatic backing layer. The electric field for Example 1 of the invention was found to be at least 10 times lower than Sample A printing to either type of print film. In addition, the total number of particles collected from the film samples was much lower when Example 1 was used as the intermediate film. Also, when an intermediate film of the invention was used in combination with a motion picture print film having a transparent antistatic backing layer rather than a print film with a carbon black-containing backing layer the total number of particles was further reduced.

The invention has been described in detail with particular reference to certain preferred embodiments thereof, but it will be understood that variations and modifications can be effected within the spirit and scope of the invention.

What is claimed is:

1. A motion picture intermediate film comprising a support bearing on one side thereof, in order, an antihalation undercoat and at least one silver halide emulsion layer, and on the opposite side of the support a transparent, process surviving antistatic backing layer, wherein the silver halide emulsion layer comprises a high bromide emulsion comprising greater than 50 mole percent bromide, based on silver, of average grain size less than 0.30 micrometers.

2. The intermediate film according to claim 1, wherein the support bears on one side thereof, in sequence: (a) an antihalation undercoat; (b) at least one red-sensitive photographic silver bromoiodide emulsion layer comprising a cyan image-dye forming coupler; (c) at least one green-sensitive photographic silver bromoiodide emulsion layer comprising a magenta image-dye forming coupler and (d) at least one blue-sensitive photographic silver bromoiodide emulsion layer comprising a yellow image-dye forming coupler; and wherein the photographic silver bromoiodide in each of the emulsion layers has an average grain size of less than 0.30 micrometers.

3. The intermediate film according to claim 2, wherein the average grain size in each of the emulsion layers is within the range of 0.04 to 0.25 micrometers.

4. The intermediate film according to claim 1, wherein the backing layer side of the film also has a lubricant-containing layer that survives film processing.

5. The intermediate film according to claim 1, wherein the electrical resistivity of the antistatic layer is less than 11 log Ω/□.

6. The intermediate film according to claim 1, wherein the antihalation undercoat comprises filter dye which is incorporated in the form of a solid particle dispersion which is readily solubilized and removed or decolorized upon standard photographic processing.

7. The intermediate film according to claim 1, wherein a protective topcoat is applied over the antistatic layer.

8. A process for forming a motion picture release print comprising (i) printing a motion picture image on a motion picture intermediate film which comprises a support bearing on one side thereof, in order, an antihalation undercoat and at least one silver halide emulsion layer, and on the opposite side of the support a transparent, process surviving antistatic backing layer, (ii) processing the intermediate film to form a developed image whereby the electrical resistivity of the antistatic layer is maintained below 11 log Ω/□ after processing, and (iii) printing the developed image onto motion picture print film to form multiple copies of the motion picture image.

9. A process according to claims 8, wherein the motion picture print film comprises a process surviving transparent antistatic backing layer.

* * * * *